US006431104B1

(12) United States Patent
Webb

(10) Patent No.: US 6,431,104 B1
(45) Date of Patent: Aug. 13, 2002

(54) BOAT MOORING DEVICE

(76) Inventor: John T. Webb, 84 Southwood St., Oshawa, Ontario (CA), L1G 6L7

( * ) Notice: Subject to any disclaimer, the term of this patent is extended or adjusted under 35 U.S.C. 154(b) by 0 days.

(21) Appl. No.: 09/635,806

(22) Filed: Aug. 11, 2000

(51) Int. Cl.[7] ..... B63B 21/00
(52) U.S. Cl. ..... 114/230.18; 114/230.15
(58) Field of Search ..... 114/230.1, 230.15, 114/230.17, 230.18, 230.19; 267/69, 70, 71, 72, 73, 74

(56) References Cited

U.S. PATENT DOCUMENTS

| | | | | | |
|---|---|---|---|---|---|
| 2,771,291 | A | * | 11/1956 | Webb et al. | 267/292 |
| 2,930,339 | A | * | 3/1960 | Trnka | 114/230.15 |
| 2,979,014 | A | * | 4/1961 | Yordi | 114/230.16 |
| 3,060,885 | A | * | 10/1962 | Nolf | 114/230.16 |
| 3,139,852 | A | * | 7/1964 | Morris | 114/230.18 |
| 4,144,831 | A | * | 3/1979 | Heydolph | 114/230.18 |
| 4,206,717 | A | * | 6/1980 | Okuda | 114/230.18 |
| 4,627,375 | A | * | 12/1986 | Davis et al. | 114/230.18 |
| 4,697,538 | A | * | 10/1987 | Day | 114/230.16 |
| 4,955,309 | A | * | 9/1990 | Ciccone | 114/230.24 |
| 5,014,638 | A | * | 5/1991 | Ilves et al. | 114/230.18 |
| 5,450,808 | A | * | 9/1995 | Beagan | 114/230.18 |
| 5,772,188 | A | * | 6/1998 | Lund | 267/69 |

FOREIGN PATENT DOCUMENTS

| | | | | |
|---|---|---|---|---|
| GB | 2483 | * | 4/1914 | 114/230.15 |
| GB | 1450060 | * | 9/1976 | 114/230.1 |

* cited by examiner

*Primary Examiner*—S. Joseph Morano
*Assistant Examiner*—Ajay Vasudeva
(74) *Attorney, Agent, or Firm*—Dowell & Dowell, P.C.

(57) ABSTRACT

This invention relates to a shock absorbing docking spacer to space a tethered boat from dockside. It comprises an elongated body having two cylindrical sections moveable longitudinally of each other to define spacer length with one of said cylindrical sections being connectable to a boat and the other of said cylindrical sections being connectable to a dock. A resilient cord is connected at one of its ends to one of said cylindrical sections and at the other of its ends to the other of said cylindrical sections to be tensioned as the cylindrical sections move longitudinally of each other due to shock forces in use to reduce spacer length. The cord cord has a resilience as aforesaid to absorb shock forces on the boat that reduce the spacer length in use, and to reassert itself and restore spacer length when shock forces are removed.

7 Claims, 6 Drawing Sheets

BOAT MOORING DEVICE

This application claims the benefit of the priority provided by United States patent application 60/148,349 filed on Aug. 12, 1999.

This invention relates to a shock absorbing spacer for spacing a tethered boat from a dock so that shock forces such as those caused by waves, wind, rising water and the like will be prevented from causing the boat to collide with the dock.

BACKGROUND OF THE INVENTION

Devices for the purpose of shock absorption and spacing have been used in association with boats for as long as there have been boats and there has always, as well, been a search for a better device.

The most simple and common device used is the simple soft plastic or rope bumper that is suspended over the side of the boat to hang between the dock and the boat for spacing the two apart. The bumper will always have its use but it is not an efficient spacer for a boat with a fine finish. In the case of a fine finish, surface damage to the boat's hull is inevitable.

Further to the simple bumper, the telescoping shock absorber type of spacer has been tried in many forms but prior constructions of this type are not in general use. The constructions available use shock absorbing features which rely on metal springs. They have not proved to be satisfactory for marine use. They are not rugged enough for exposure to water and weather encountered in boating conditions and do not satisfactorily soften impact forces.

BRIEF SUMMARY OF THE INVENTION

This invention relates to is an improved spacer of the telescopic type. The essence of the improvement is the avoidance of metal spring means of shock absorption, while still incorporating simple and inexpensive component parts. The invention employs a resilient length of cord to absorb shock. The cord is not affected by the wet conditions of boating and the unit has the ruggedness long sought after in the telescopic type of shock absorber. The construction is simple, rugged and inexpensive to make. It is easy to use and effectively protects a tethered boat from the harm of being dashed against the side of a dock by shock forces of wind, waves and rising water levels.

It is an object of this invention to provide a docking spacer of the telescoping type that performs better under the adverse moisture conditions of boating.

It is a further object of this invention to provide a docking spacer that is simple to manufacture and easy to maintain.

It is a further object to provide a docking spacer that inexpensive.

With these and other objects in view an boat spacer according to one aspect of this invention comprises a shock absorbing docking spacer to space a tethered boat from dockside. It comprises an elongated body having two tubular sections moveable longitudinally of each other to define spacer length, one of said sections being connectable to a boat and the other of said sections being connectable to a dock; a resilient cord connected at one of its ends to one of said sections and at the other of its ends to the other of said sections to be tensioned as the sections move longitudinally of each other due to shock forces in use to reduce spacer length, said cord having a resilience as aforesaid to absorb shock forces on the boat that reduce the spacer length in use, and to reassert itself and restore spacer length when shock forces are removed.

BRIEF DESCRIPTION OF THE DRAWINGS

The invention will be clearly understood after reference to the drawings read in conjunction with the drawings. In the drawings.

The illustrations are not to scale.

DETAILED DESCRIPTION OF THE DRAWINGS

Figure 11:
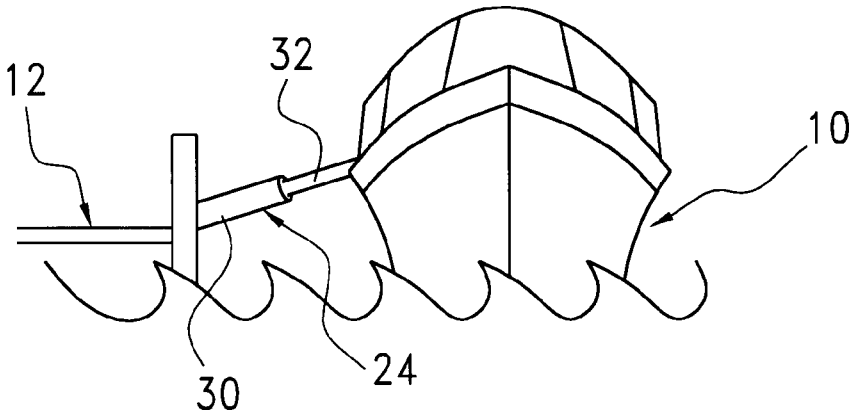
FIGS. 11 and 12 are schematic illustrations showing how the device can still maintain its effectiveness in different tide situations.
Figure 12:
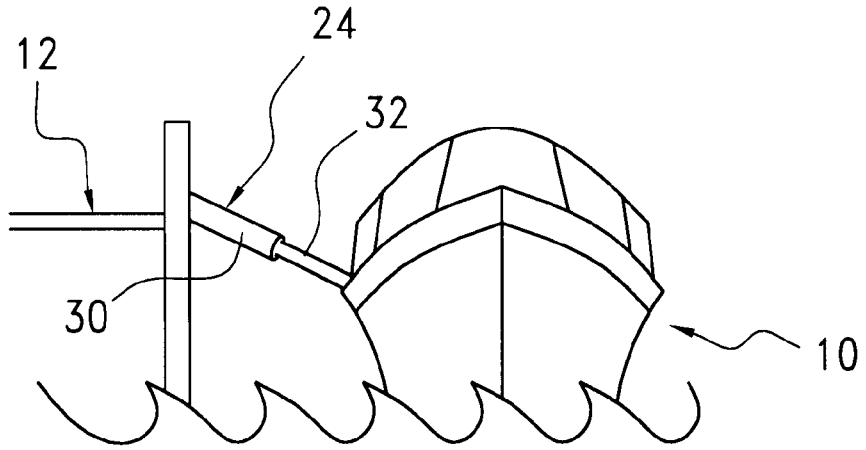

In the drawings, the numeral 10 generally refers to a boat tethered to a dock generally indicated by numeral 12 by means of a tether rope 14. (Ropes are not shown in FIGS. 11 and 12, but it is intended that this device be used in combination with rope securement.) The tether rope 14 extend from dock brackets 16 to boat brackets 18 according to a normal boating tether practice.

Figure 9:
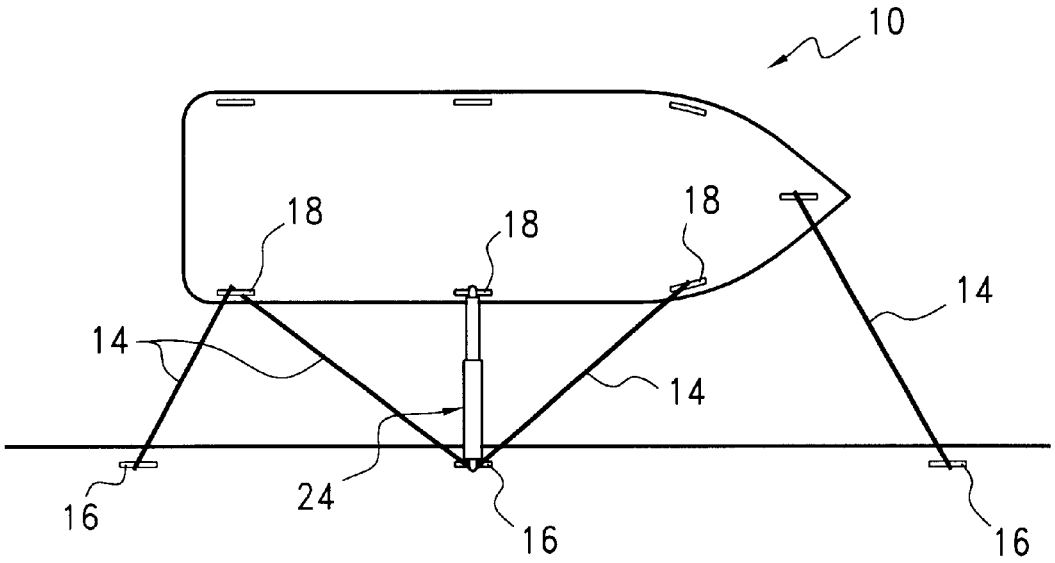
FIG. 9 and FIG. 10 are schematic illustrations showing how the device can be used for a docked boat.
Figure 10:
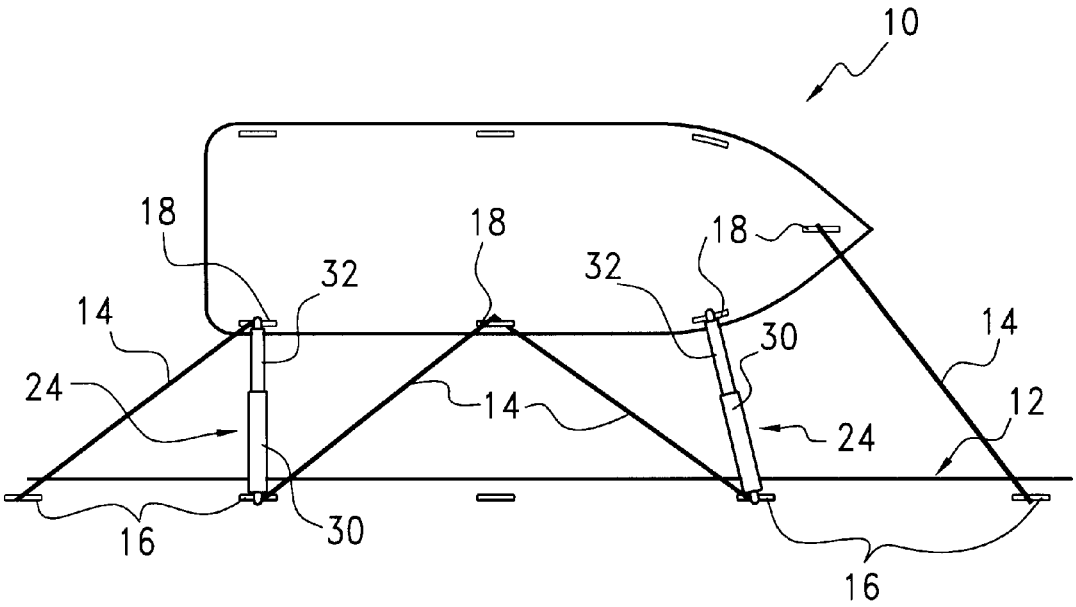

Telescopic spacers generally indicated by the numeral 24 selectively extend between boat brackets 18 and dock brackets 16 to keep the boat spaced from the dock according to user preference and requirements as illustrated in FIGS. 9 and 10.

Figure 8:
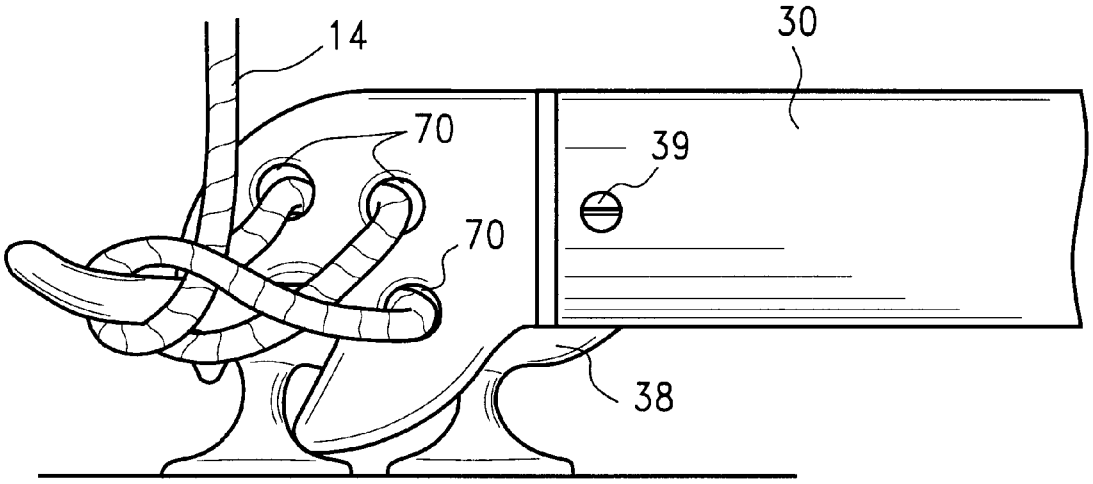
FIG. 8 is a sectional illustration showing how the device can be secured to a dock or boat.

The construction of the preferred embodiment of the spacer, generally indicated by the numeral 24, is illustrated in FIGS. 1 to 4 of the drawings. The embodiment of the invention there shown has a body formed from two telescoping cylinders 30 and 32 each having a hooked end member 34 and 36 respectively for locking with a typical dock or boat bracket, such as that shown in FIG. 8, and numbered 38. The end members 36 and 38 can be secured to the cylinders in any number of ways. The inventor has found it effective to use threaded screws 39 to achieve this end.

Figure 1:
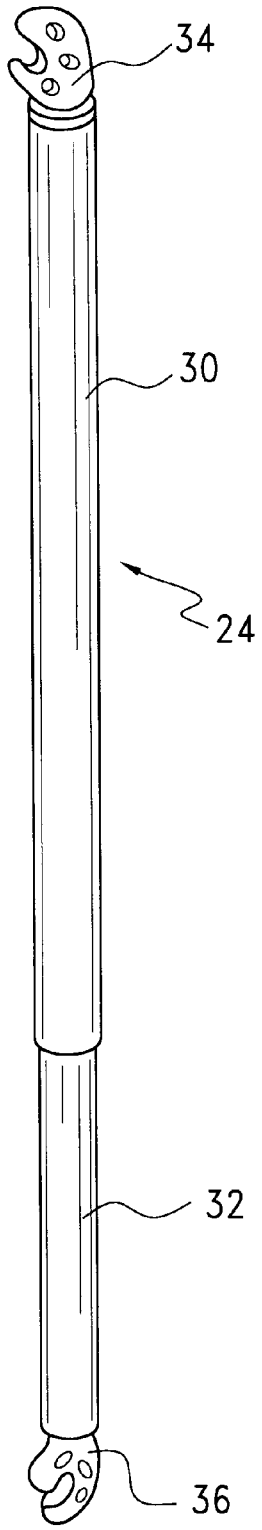
FIG. 1 is a perspective illustration of the preferred embodiment of this invention.
Figure 2:
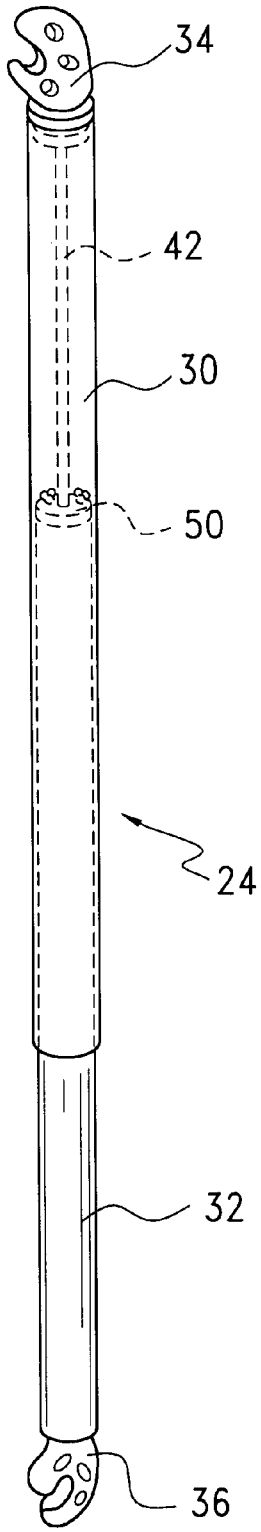
FIG. 2 is the illustration of FIG. I showing in phantom the telescopic arrangement of the two tubular sections of the preferred embodiment.
Figure 3:
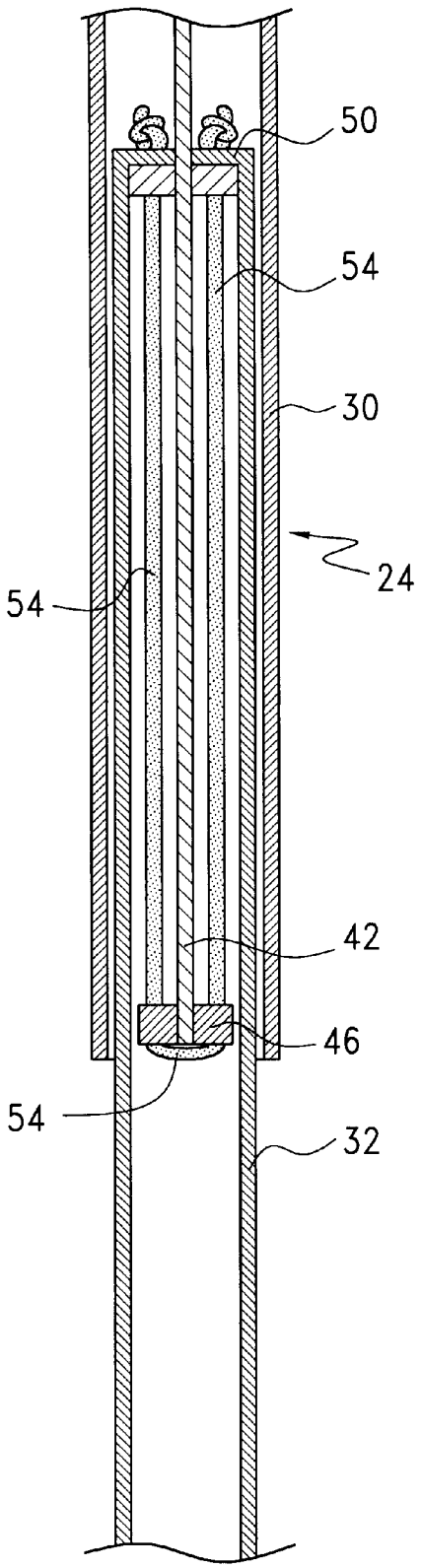
FIG. 3 is a partial longitudinal cross-section of the preferred embodiment showing the resilient cord in tension.
Figure 4:
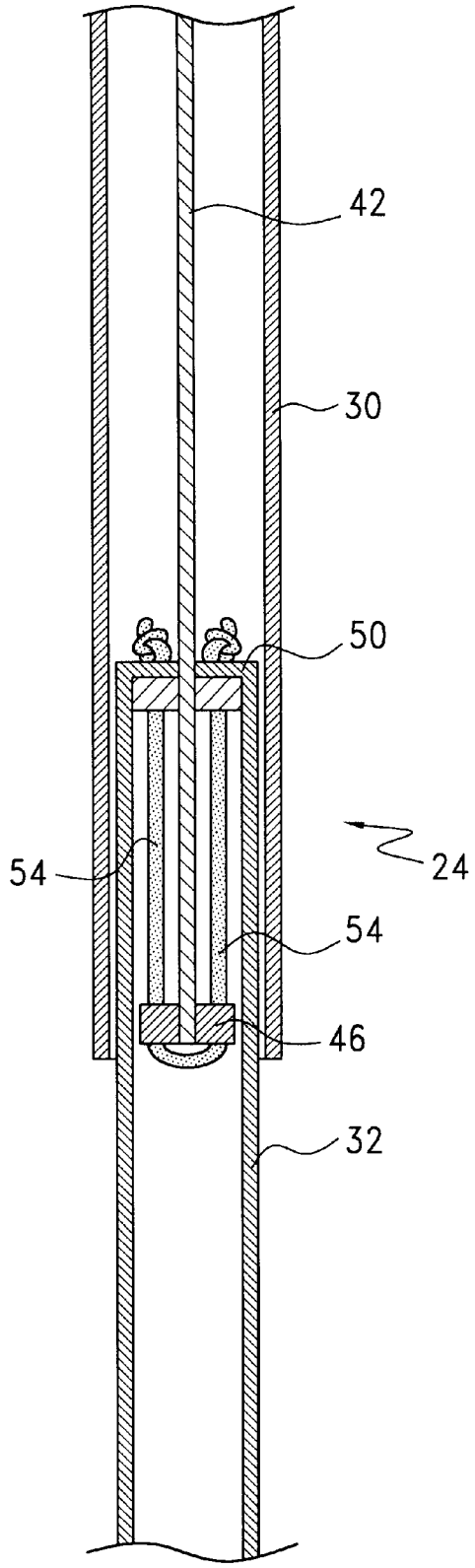
FIG. 4 is partial longitudinal cross-section of the preferred embodiment showing the resilient cord not in tension.
Figure 5:
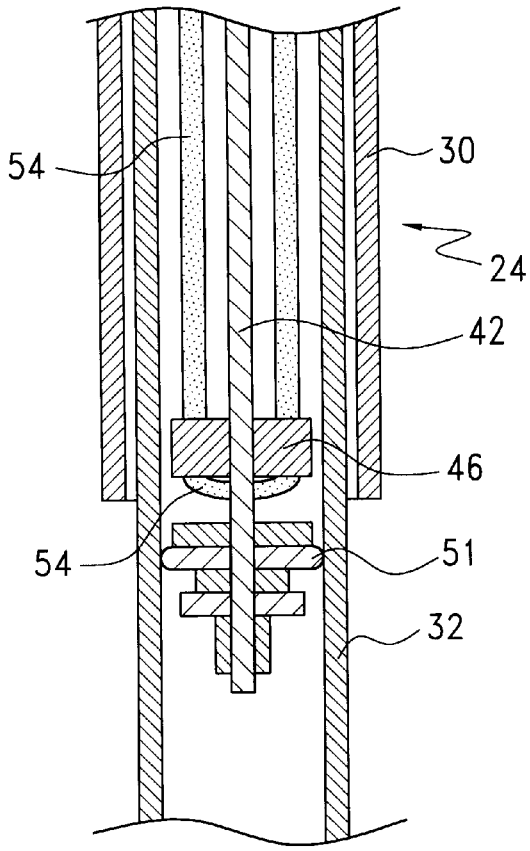
FIG. 5 is partial longitudinal cross-section of a further embodiment showing the use of an o-ring to enhance shock absorption.
Figure 6:
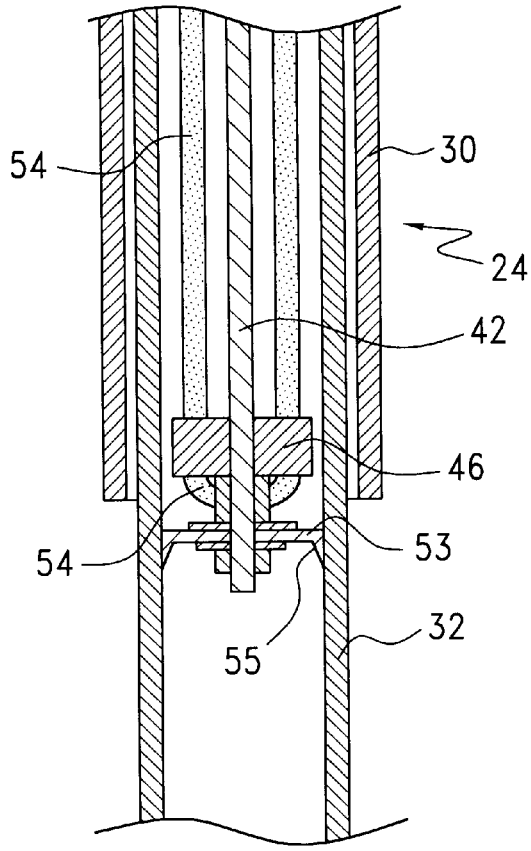
FIG. 6 is a partial longitudinal cross-section of a further embodiment showing the use of a disk with a re-enforced outer edge portion to enhance shock absorption.
Figure 7:
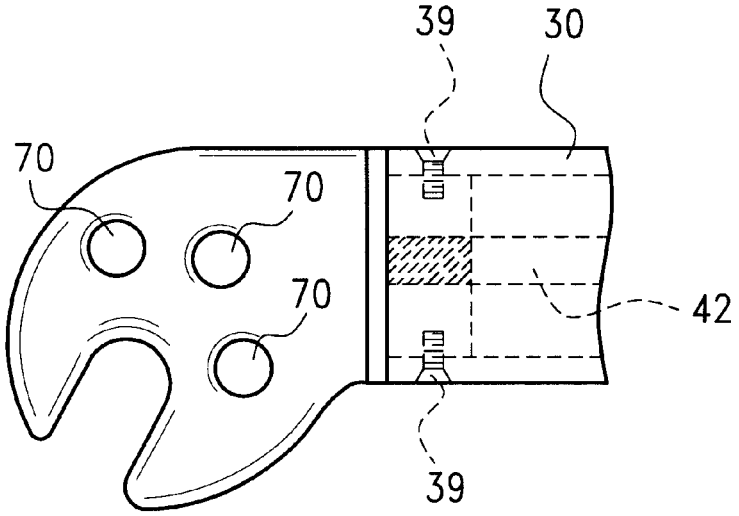
FIG. 7 is a sectional illustration of the preferred embodiment showing how the end piece is mounted to the device.

FIGS. 2, 3 and 4 show the interior of the telescoping sections of the spacer 24. Section 30 has a rod 42 anchored to its end as at 34 in FIG. 2 and in FIG. 7. As shown in FIG. 7 the rod 42 is threadedly secured to end member 34. A disk 46 is threadedly secured to the free end of rod 42. The free end of section 32 retains a plug 50 through which the rod 42 extends. A resilient cords 54 is wound through holes in the disk 46 with its free ends being tied in knots at 51 and 53 for securement to plug 50. A force against a tethered and spaced boat that drives the boat towards the dock telescopes the cylinders 30 and 32 inwardly and separates the disc 46 and plug 50 to tension the cord 54 as shown in FIG. 3. When the forces abate the cords 54 reassert themselves to assume their normal untensioned condition and return to the cylinders outwardly as shown in FIG. 4.

The resilience of the cords, the size of the cylinders, the specification of the road are all designed for the boat and anticipated shock forces and can be altered to suit the particular circumstances required. Also the number of cords used can be increased. In the embodiment shown, only one cord is used, but further winding of the cord or the adding of another cord is possible to increase the possible shock absorption of the device. Cords that are resilient and suitable are readily available off the shelf and are commonly referred to as bungee cords or shock cords. The inventor has reduced his invention successfully to practice by using tubes made from poly vinyl chloride having a length of 2.5 feet, wall thickness of 3/16 inches, a diameter of 2 3/8 inches for the outer tube and a diameter of 1 15/16 inches for the inner tube and two cords with a thickness of 3/8" and a length of 26", each wound once around the end disc. The cords used were standard rubber-nylon composition of the type generally manufactured and sold as "bungee" or "shock" cords. The rod, made of stainless steel, had a length of 30" and a diameter in crosssection of 3/8". The device so produced was able to effectively singlely provide shock absorption for a power boat of 22 feet length and 4000 lbs. weight in normal docking conditions. It will be apparent to those skilled in the art that the specification can be changed to suit particular purposes or anticipated environmental conditions or availability of materials. For instance, the rods could be just as easily made from aluminum.

Also, modifications such as a rubber o-ring 51 secured to the rod 42 near the rod's end or a rubber disc member 53 having a fortified outer rim portion 55 which, in each case, slideably engages with the inner surface of the smaller cylinder 32 as the cord 54 is tensioned to further dampen shock in use. The o-ring 51 and the disc member 53 are secured to the rod 42 by threaded washers and nuts.

In use the spacers are set up as illustrated and the tether rope is pulled taut so as to take up any slack in the cylinders as shown in FIGS. 9 and 10 as the cord 54 is untensioned or slightly tensioned. Any conventional manner of securement can be used. The inventor has found it effective to used hooked end members 36 formed with holes 70 to facilitate tying with rope 14. Variations to the design of the end members may be used as well, but by using end members that lend themselves to conventional securement, the need for structural modifications to either the boat or the dock to use this device is not required. In severe conditions, more than one device can be easily utilized as illustrated in FIG. 10, again without structural modification to either the boat or the dock.

Once set up, in the even that there should occur a substantial force against the boat that tends to drive it towards the dock, the spacer will telescope inwardly to tension the cord 54 to the limit of the cords resilience for that force. The shock cord 54 is designed to bottom out and prevent further inward telescoping at a force somewhat greater than that expected.

Embodiments of the invention other than the one illustrated will be apparent to those skilled in the art. For example, aluminum can be used instead of stainless steel for the rod. Similarily, more than one cord can be used. The body only needs two sections on any form that are moveable longitudinally of each other to rig the resilient cord to space a boat according to the invention. Other modifications will be apparent to those skilled in the art.

The embodiments of the invention in which an exclusive property or privilege is claimed are defined as follows:

1. A shock absorbing docking spacer to space a tethered boat from dockside comprising:

an elongated body having two cylindrical sections, the first of said two cylindrical sections having a diameter greater than the diameter of the second of said two cylindrical sections, said two cylindrical sections being movable longitudinally of each other in telescopic relationship to define spacer length, one of said cylindrical sections being connectable to a tethered boat and the other of said cylindrical sections being connected to a dock;

there being a rod having a first end and a second end with the first end of the rod being fixedly mounted to the first cylindrical section and the second end being a free end which extends inwardly into the second cylindrical section when spacer length is reduced, there being a first cord-attachment means mounted on the second end of the rod which extends into the first cylinder;

there being a plug fixedly mounted to the second of said two cylindrical sections, said plug having an opening through which said rod extends to permit movement of the second end of the rod and the cord-attachment means within the second cylindrical section when the two cylindrical sections move longitudinally of each other in telescopic relationship;

a resilient cord connected to the plug and to the cord-attachment means to increase tension of the resilient cord as the cylindrical sections move longitudinally of each other to reduce spacer length;

said resilient cord having a resilience as aforesaid to absorb shock forces between the tethered boat and dockside in use, and to reassert itself and restore spacer length when said shock forces are removed.

2. A shock absorbing spacer to space a tethered boat from dockside as claimed in claim 1 wherein more than one said resilient cord connected to the plug and to the cord attachment means as aforesaid.

3. A shock absorbing spacer to space a tethered boat from dockside as claimed in claim 1 where there is provided a hooked end member on each end of the docking spacer for securing the device to a dockside and a tethered boat in use.

4. A shock absorbing docking spacer to space a tethered boat from dockside as claimed in claim 1 wherein there is provided a hooked end member formed with holes on each end of the docking spacer for rope securing the device to a dockside and a tethered boat in use.

5. A shock absorbing docking spacer to space a tethered boat from dockside as claimed in claim 1 wherein an o-ring is attached to the docking spacer for slidable engagement against the first of said cylindrical sections during use to dampen shock experienced by the device.

6. A shock absorbing docking spacer to space a tethered boat from dockside as claimed in claim 1 wherein a disc shaped member is attached to the docking spacer for slidable engagement against the first of said two cylindrical sections during use to dampen shock experienced by the device.

7. A shock absorbing docking spacer to space a tethered boat from dockside as claimed in claim 1 wherein the first cord-attachment means is a disc.

* * * * *